US005867965A

United States Patent [19]

Pilz et al.

[11] Patent Number: 5,867,965

[45] Date of Patent: Feb. 9, 1999

[54] TILE SETTING MACHINE

[76] Inventors: Jack Pilz, 105 Willowbrook Road, Thornhill, Ontario, Canada, L3T 5L2; Dario Sanchez, 66 Merkley Square, Scarborough, Ontario, Canada, M1G 2Y7

[21] Appl. No.: 823,689

[22] Filed: Mar. 25, 1997

Related U.S. Application Data

[63] Continuation-in-part of Ser. No. 401,891, Mar. 10, 1995, abandoned.

[51] Int. Cl.[6] ..... B04D 15/00; B04F 21/20

[52] U.S. Cl. ..... 52/749.1; 52/749.11; 404/99; 404/73; 294/64.1

[58] Field of Search ..... 52/749.1, 749.11, 52/749.14; 404/99, 73; 294/64.1; 15/380, 381, 382, 349, 359, 52.2

[56] References Cited

U.S. PATENT DOCUMENTS

| | | | |
|---|---|---|---|
| 2,420,811 | 5/1947 | Brewster et al. | 294/64.1 |
| 3,678,645 | 7/1972 | Valdes | 52/749.11 |
| 4,000,536 | 1/1977 | Nayfa et al. | 15/380 X |
| 4,137,601 | 2/1979 | Eschenbach | 15/52.2 X |
| 4,221,356 | 9/1980 | Fortune | 294/64.1 X |
| 4,227,834 | 10/1980 | Crowe | 405/303 |
| 4,583,343 | 4/1986 | Camp | 52/749 |
| 4,729,141 | 3/1988 | Berg et al. | 15/359 X |
| 4,893,451 | 1/1990 | Valente | 52/749 |
| 4,974,283 | 12/1990 | Holsten et al. | 15/349 |
| 4,983,809 | 1/1991 | Maiette et al. | 294/64.1 X |

FOREIGN PATENT DOCUMENTS

| | | | |
|---|---|---|---|
| 2459340 | 1/1981 | France | 52/749.11 |
| 4302660 | 10/1992 | Japan | 52/749.11 |
| 8503510A | 7/1987 | Netherlands . | |
| 612991 | 6/1978 | Russian Federation . | |

*Primary Examiner*—Carl D. Friedman
*Assistant Examiner*—Winnie S. Yip
*Attorney, Agent, or Firm*—Rothwell, Figg, Ernst & Kurz

[57] ABSTRACT

A fully portable, self-contained tile setting machine has a battery driven vibrator and a manually actuable suction pad with which the tile is secured. Out-rigger arms provide visual datum by which the tile in-process can be set level with two adjoining, previously set tiles or other reference surfaces, and a manual release of the suction pad permitting unimpeded removal of the setting machine from the just-set tile. The degree of vibration of the machine is adjustable, to permit modulation of the extent of vibration imparted to the tile, in setting it.

14 Claims, 4 Drawing Sheets

TILE SETTING MACHINE

This application is a continuation-in-part of application Ser. No. 08/401,891, filed Mar. 10, 1995 now abandoned.

FIELD OF THE INVENTION

This invention is directed to a tile setting machine, and in particular to a hand portable, fully self contained, independently powered machine.

BACKGROUND TO THE INVENTION

The use of tile setting machines is well known, being taught by Valente, in U.S. Pat. No. 4,893,451. Eschenbach teaches a floor conditioning machine in U.S. Pat. No. 4,137,601.

The Valente system is a noisy, cumbersome arrangement comprising a heavy, hand-held tile setting machine connected by air suction line to a compressor or like machine.

The tile setting machine itself has an air driven vibrator and a suction cup, both powered by the compressor.

The compressor requires to be accommodated in the vicinity of where the tiling is to be carried out, and to be connected to an external power source, which on a building site frequently presents its own difficulties. In operation, the compressor is very noisy, and the air hose connection to the tile laying machine is most inconvenient, and also forms a safety hazard.

In operation, the cumbersome and relatively heavy Valente machine, which weighs between 10 and 14 lbs., requires to be solidly supported upon its extendable supporting legs in order to achieve precision in placing the tiles.

In practice, many users habitually leave open the vacuum connection to the suction cup, resulting in contamination of the suction line by local detritus, leading frequently to loss of suction, and hence, to inoperability of the machine.

The Eschenbach machine is even larger and heavier than the Valente machine, and also requires an external power connection, which on site can prove most difficult to obtain.

SUMMARY OF THE INVENTION

The present invention provides a light-weight, hand portable, battery driven vibratory tile setting machine.

The machine, which is operable at site totally independently of external power sources, comprises a housing having handle means extending therefrom;

an electric motor mounted within the housing;

rotatable out-of-balance, vibration generating weight means connected in driven relation to the electric motor;

battery means connected in current supplying relation with the motor;

a housing head portion having a deformable suction-creating suction disc connected thereto;

lever means connected to the disc in deformation controlling relation therewith, in use to suction the disc to the face of a tile, thereby securing the tile to the machine and enabling the positioning of the tile onto a setting bed;

and switch means connecting the battery means to the motor, whereby, upon actuation of the switch means the setting machine and the tile are vibrated by the vibration generating weight means, enabling controlled setting of the tile in the setting bed.

The machine includes machine orientation means, to facilitate aligning the machine with a selected reference edge of at least one tile.

The machine orientation means includes a side portion of the machine housing, in use to enable rapid, substantial alignment of the machine with a tile to be set, and with rapid, substantial alignment with a reference surface edge.

The reference surface edge may comprise the edge of an already set tile.

The orientation means may include machine levelling means to indicate when the suction disc is substantially level, to facilitate rapid application of the disc to the face of a tile.

The machine battery means preferably comprises a replaceable battery pack.

The machine orientation means may include indexing means having at least one foot pad locatable in outwardly spaced relation from the machine, in predetermined height reference relation with the suction disc.

The machine may have two of the foot pads, removably secured to the machine by way of laterally extending arms arranged in mutually inclined right-angled relation.

Adjustment of the foot pad or pads to hang level with the lower face of the suction disc provides a datum reference for the disc, and hence, the upper face of the tile. As the tile is vibrated and set downwardly into its bed the foot pad or pads approach the adjacent reference or datum surface to which the tile is being referenced. Upon contact of the pad with the reference surface the setting of the tile is complete, so that the vacuum lever may be released upwardly, and the machine can be re-deployed.

The machine suction lever means preferably has a bi-stable, two position lever, with a first position wherein the suction disc is substantially undeformed, and a second position wherein the disc is deformed to a suction-generating condition.

In one embodiment the machine weight means is directly secured to the rotor of the motor, to provide relatively high frequency vibration to the machine, and hence to the tile.

In a further embodiment the weight means is connected to the motor by way of a reduction gear, to provide vibration of the machine at a frequency less than the frequency of the motor.

The reduction gear connecting the motor to the rotatable weight means may be changed, in order to select the rotational speed of the weight means and thereby control the vibrational frequency of the machine. A simple, single reduction gear is preferred.

Changes to the vibrational frequency are influenced by the individual mass of the tiles being laid. The heavier tiles, such as Mexican clay tiles may weigh as much as 22 kg (48 lbs.), and require low frequency vibration for effective setting.

A further factor influencing the selection of setting frequency (of vibration) is the density and viscosity of the mud, glue or other medium of the setting bed.

One aspect of the subject machine is its effectiveness in displacing air bubbles from the underface of the tile as it is set, thereby effecting a good structural bond between the tile and its bed.

The nature and thickness of the setting bed are influenced by the condition of the floor surface. In the case of a pre-levelled floor a thin "soup" of mud or glue may suffice, whereas in the instance of an uneven floor a mud bed varying in thickness from ¾ inch to 2-inches may be needed.

Where the tile has to be sunk into a denser bed, a lower rate of vibration is usually more effective.

The machine housing may be of substantially square section. The machine housing preferably has a straight sided section, such that the sides constitute orientation references relative to the tile, or to other desired datum, such as walls or skirting edges.

The battery power pack of the subject machine is good for about a full days work of tile setting, and lends itself to ready replacement by way of a spare power pack, if need be. Such a power pack is pre-charged and readily carried on the users person.

The low voltage of the system eliminates any danger of dangerous shock to the user or others. The use of a plastic body also is advocated from a safety standpoint.

The preferred bi-stable lever arrangement of the suction-generating disc is arranged to give its "disengaged" function when in an upright position. By placing the machine down upon a tile, preferably with the machine casing aligned with a side of the tile and depressing the vacuum generating lever to its second, horizontal position, the vacuum disc is deformed upwardly at its centre, and locked into that condition until the lever is returned to an upright position, when the tile has been set.

The cam-like action of the vacuum control lever is transmitted to the suction disc by way of an intermediate yoke frame. Thus, operation of the bi-stable, vacuum-generating lever is ergonomically based, with a downward motion of both of the machine and the lever minimizing both concentration and effort required of the operator. The force applied upon the lever when generating suction as the disc also reinforces the sealing force applied to the disc. The disc has a lifting capacity of up to 45 kg (100 lbs.).

The levelling aspect of the machine orientation means may comprise a spirit level located on the top or "deck" of the machine, the level having a centering bubble within a circular sight glass, being readily viewed from above, when levelling a tile secured by the suction disc to the machine.

In use, with a tile secured to the suction disc by applying the machine in orientated relation upon the top face of a tile, and actuating the (suction) lever, the tile is then positioned in its desired location upon the setting bed.

Actuation of the switch energizes the motor, to vibrate the tile, which is then lowered down into the bed until the desired set is achieved. This may be monitored by eye, or by use of the outrider arms, with their freely suspended contact feet.

Release of the suction lever to its upright position releases the vacuum within the suction disc, and the machine from the set tile.

BRIEF DESCRIPTION OF THE DRAWINGS

Certain embodiments of the invention are described, by way of illustration, without limitation of the invention thereto other than as set forth in the claims, reference being made to the accompanying drawings, wherein:

DETAILED DESCRIPTION OF THE INVENTION

Figure 1:
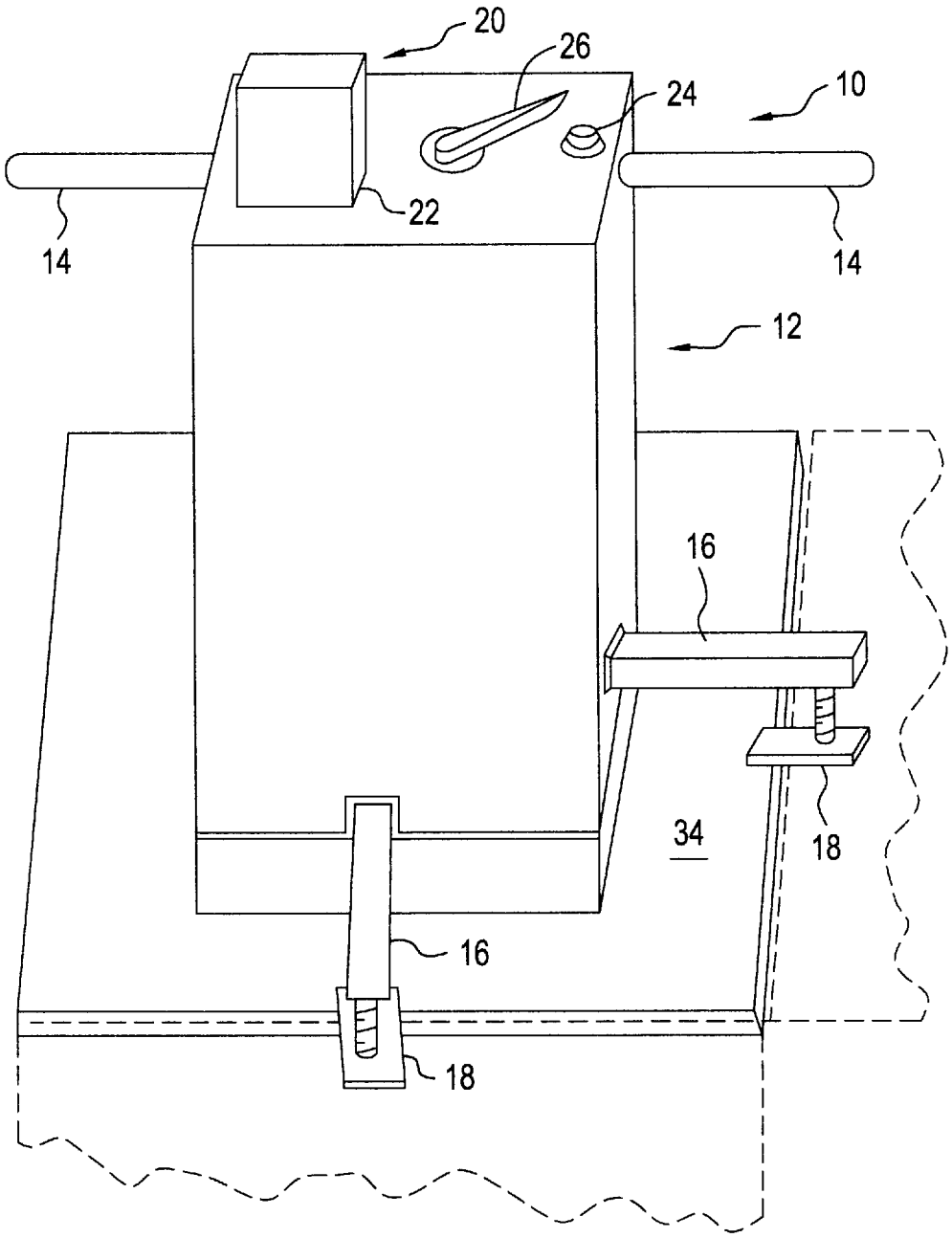
FIG. 1 is a schematic perspective view of the subject tile setter.

Referring to the drawings, the tile setter 10 has a light-weight plastic body 12, with handles 14 extending therefrom.

A pair of outwardly slidable, removable indexing arms 16 are provided with adjustable footpads 18.

A battery power pack 20 is located in battery housing 22, there being a control switch 24, illustrated as being a push-on, push-off button type switch.

A pressure driven switch may be substituted therefor.

A vacuum-applying and vacuum-releasing lever 26 is mounted on the top of the body 12. The lever has a cam-like head portion with flats thereon corresponding to the active and deactivated positions of the lever, to afford the desired bi-stable operation.

Figure 2:
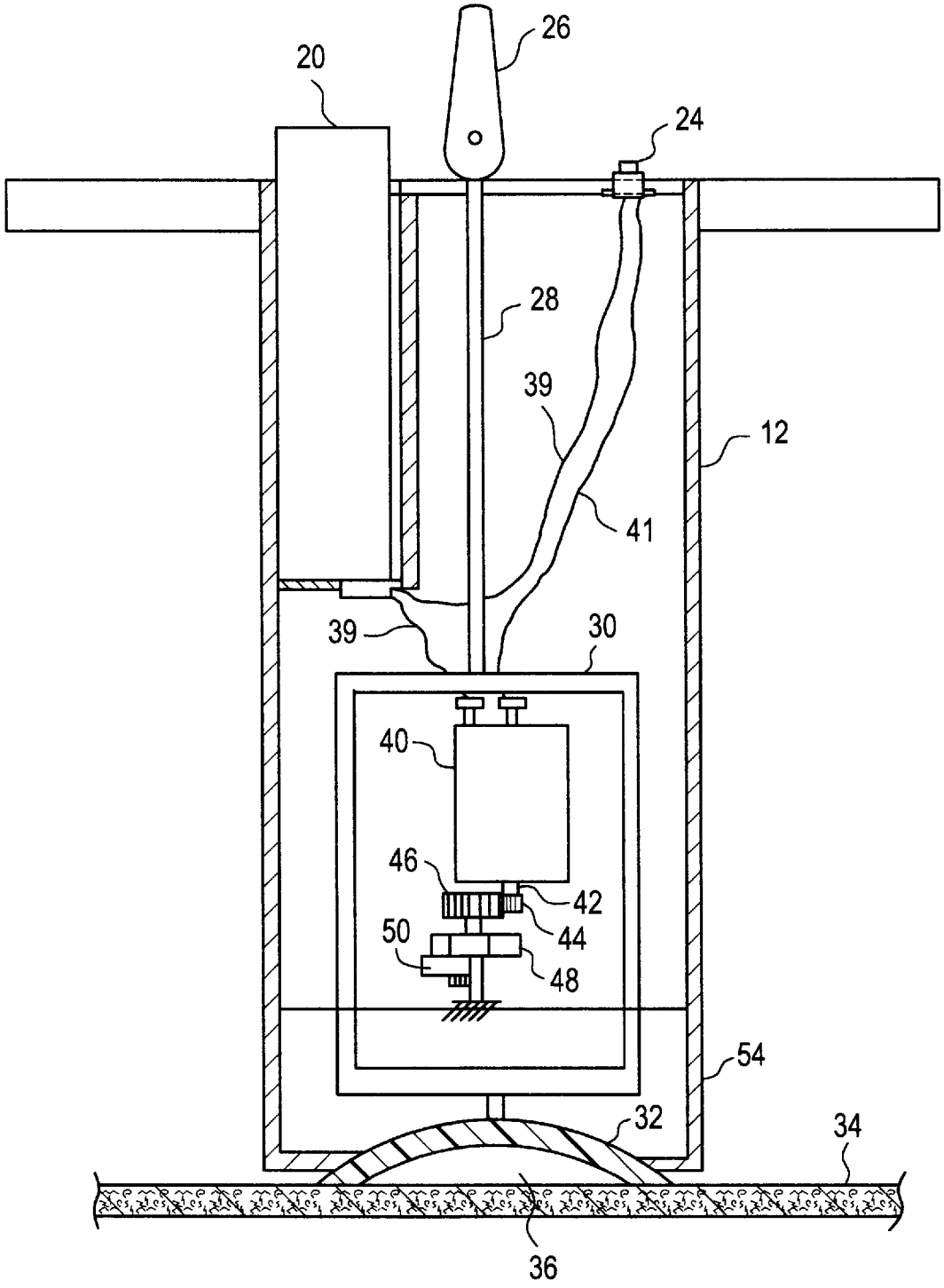
FIG. 2 is a schematic side elevation, in lateral section, of one embodiment.

Referring to FIG. 2, which shows the machine without the indexing arms 16, the vacuum control lever 26 is shown in its raised, inoperative position. A connecting rod 28 and yoke frame 30 connect the arm 26 to the centre of a rubber vacuum disc 32. Downward rotation of the lever 26 to a horizontal attitude causes the frame 30 to raise, thereby causing the rubber suction disc 32 to become dome shaped.

The tapered edges of the flexible suction disc 32 are of soft rubber and seal hermetically to the tile 34, so that upward doming of the disc 32 generates a partial vacuum therein. Atmospheric air pressure then keeps the tile 34 secured to the disc 32 until the partial vacuum is released by raising of the lever 26 to its upright (released) position.

The battery pack 20 is connected by leads 39, 39, 41, through the switch 24 to a direct current (DC) electric motor 40.

The switch 24 may be located internally of the machine casing, and the depressing of an external push-button against a spring-loaded push rod may be used to effect switching of the motor. This arrangement facilitates sealing of the system against dust.

The motor output shaft 42 has a toothed pinion wheel 44 in driving relation with gear wheel 46. The gear wheel 46 drives a flywheel 48, shown as having an adjustable eccentric weight 50, for which the radius of rotation may be readily adjusted.

Alternatively, the flywheel 48 may be eccentrically offset, to provide a desired out-of-balance force for a given rotational speed. A change in speed by changing the ratio of gears 44, 46 then changes both the frequency and the force of vibration.

The extent of vibration required is affected by ambient temperature conditions, and the viscosity of the setting bed of "mud", glue or other bed material.

The vibration generated upon rotation of motor 40 transmit to the machine body 12 and thence to the disc 32 and the tile 34.

Figure 3:
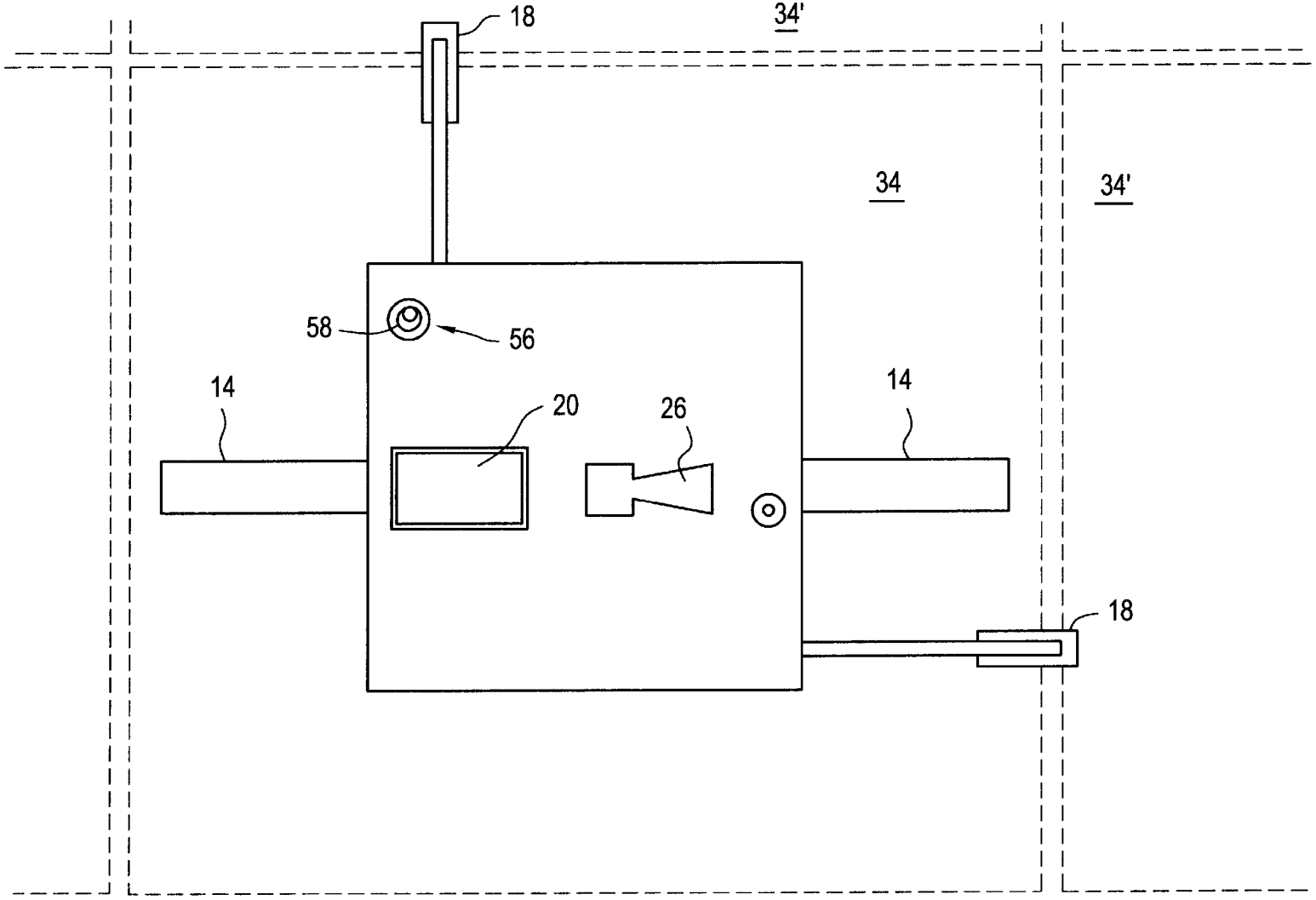
FIG. 3 is a schematic plan view of the setter in use.

In the FIG. 3 embodiment a semi-spherical spirit level 56 has a bubble 58 that may be fairly readily centered by a user, whereby the disc 32 is oriented substantially horizontal, for level placement of the tile 34.

The foot pads 18 are shown in overlapping relation with adjacent, previously laid tiles 34'. Thus, with the spirit level indicating the tile 34 to be effectively level, upon contact being made by the pads 18 against the adjacent reference surfaces provided by the tiles 34', the setting of the tile 34 is complete. Upon upward release of the control lever 26, the suction disc loses its partial vacuum and is released from the tile, permitting redeployment of the machine.

The slidably removable arms 16 are mounted in the body 12 of the machine 10 (see FIG. 1) and extend parallel with the respective sides of the machine body 12, such that an extended orientation reference is provided. Attachment of the machine 10 to a tile 34, having the tile substantially centered in relation to the machine 10, and with its sides in parallel relation with the arms 16 permits precise positioning of the tile 34 in parallel relation with the previously laid tiles of adjacent courses of tile. The adjustable foot pad 18 being previously set level with the bottom of the suction disc 32, upon the pad 18 making contact with an adjacent reference surface, the setting of that tile 34 is complete.

The battery pack 20 is sized to the rating of the electric motor 40 to provide about 1½ hours of continuous running, which is equivalent to a normal working day of tile laying output.

The tile setter 10 weighs approximately 3.4 kgm (about 7½ lbs.) and is totally independent, at the site, from outside power supply or auxiliary powerplants. It is totally hand portable, and the provision of a spare power pack assures convenient stand-by power for total day by day independence.

The alternative use of a battery pack worn on the person of the user also is feasible, wherein switching may be effected at the pack, or by connecting/disconnecting one of the pack leads.

Figure 4:
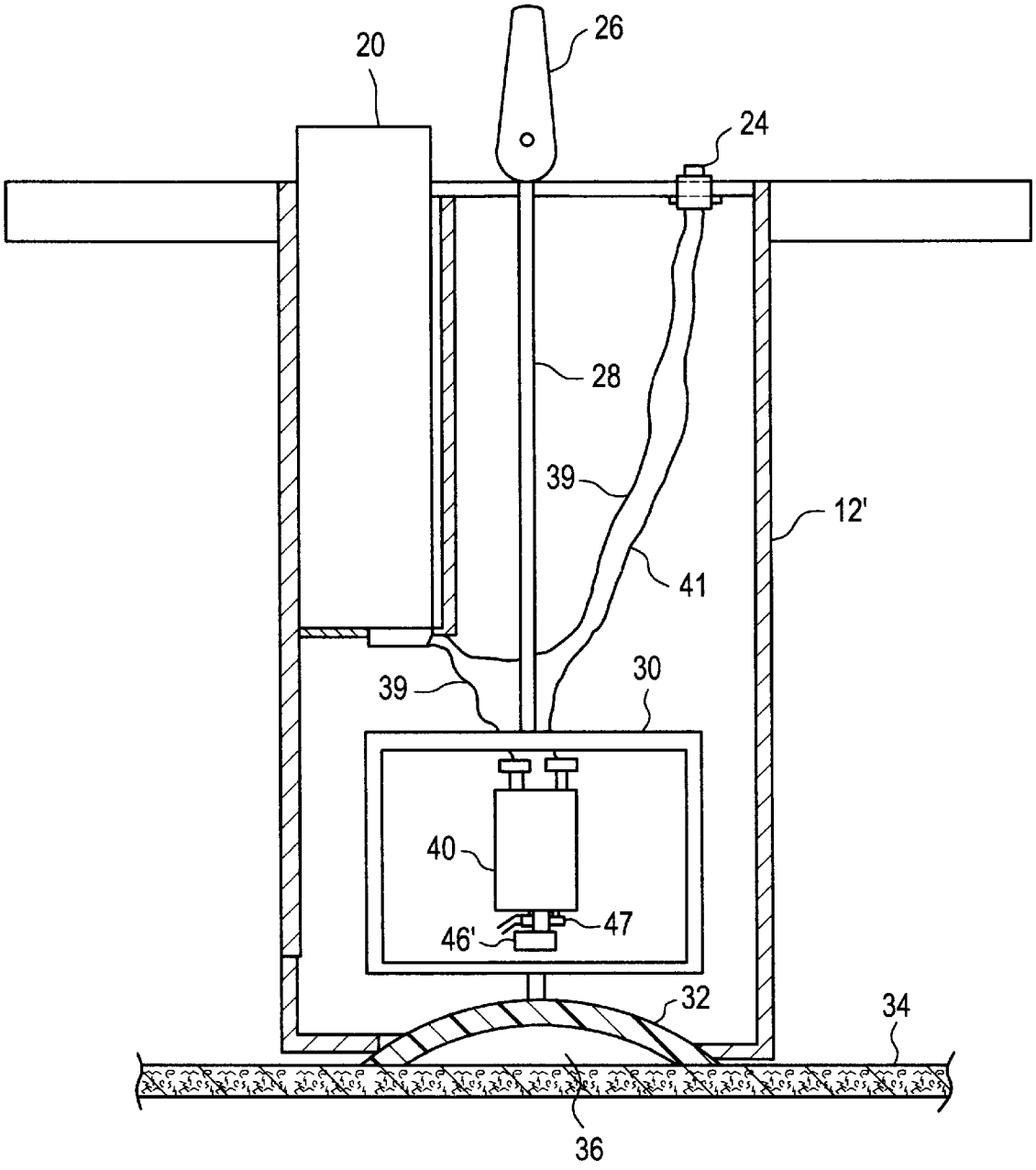
FIG. 4 is a view similar to FIG. 2, of a smaller embodiment.

In the FIG. 4 embodiment the machine body 12' is smaller and lighter, with the eccentric, out of balance weight 46' directly attached to the rotor of motor 40. A rotor bearing 47 is secured to the body 12' of the machine.

COMMERCIAL UTILITY

The subject tile setter is totally and eminently practical and should experience wide use in many parts of the world.

What is claimed:

1. A light-weight, hand-portable, self-contained vibratory tile-setting machine that is operable independently of external power sources, said machine comprising:

a housing having handle means extending from said housing for carrying and controlling said tile-setting machine.

a battery-powered electric motor mounted within the housing;

rotatable, out-of-balance, vibration-generating weight means connected in driven relation to said battery-powered electric motor;

battery means connected in current-supplying relation with the motor;

a housing head portion having a deformable, suction-creating suction disc connected thereto;

lever means connected to said suction disc in deformation-controlling relation therewith, said lever means being selectable positionable in a first position in which said suction disc is caused to be deformed, thereby creating a suction force between said suction disc and a tile positioned against said suction disc to secure said tile to the machine, and a second position in which said suction disc is not caused to be deformed such that no suction force is created between the suction disc and the tile; and switch means connecting said battery means to said motor whereby, upon actuation of the switch means, said tile-setting machine and a tile secured thereto are vibrated by means of rotation of said vibration-generating weight means.

2. The machine as set forth in claim 1, including machine-orientation means to facilitate alignment of the machine with a selected reference edge of at least one tile.

3. The machine as set forth in claim 2, said orientation means comprising a side portion of said machine housing.

4. The machine as set forth in claim 2, said orientation means including levelling means to indicate when said suction disc is substantially level.

5. The machine as set forth in claim 1, said battery means comprising a replaceable battery pack.

6. The machine as set forth in claim 2, said orientation means including indexing means having at least one foot pad locatable in outwardly,spaced relation to the machine and in predetermined, height-reference relation to the suction disc.

7. The machine as set forth in claim 6, said machine having two said foot pads removably secured to said machine by laterally extending arms arranged in mutually inclined, right-angle relation.

8. The machine as set forth in claim 1, wherein said level means is bi-stable.

9. The machine as set forth in claim 1, wherein said weight means are directly secured to said motor to provide relatively high frequency vibration to said machine.

10. The machine as set forth in claim 1, wherein said weight means are connected to said motor by means of a reduction gear to cause said machine to vibrate at a frequency less than the frequency of rotation of said motor.

11. The machine as set forth in claim 1, said housing being of straight-sided section such that said sides constitute an orientation reference for said tile.

12. The machine as set forth in claim 11, said housing being of substantially square section.

13. The machine as set forth in claim 2, said orientation means including spirit level means located in visually accessible relation to facilitate levelling said machine.

14. The machine as set forth in claim 10, wherein said reduction gear is replaceable with a gear of a different size to facilitate a change in the frequency of vibration of the machine.

* * * * *